United States Patent [19]

Takeuchi et al.

[11] 4,269,633

[45] May 26, 1981

[54] METHOD FOR COLORING STAINLESS STEEL

[75] Inventors: Takeshi Takeuchi; Hisao Takamura; Kiyoshi Takatsu; Hidehiro Shibata, all of Ichikawa, Japan

[73] Assignee: Nisshin Steel Co., Ltd., Tokyo, Japan

[21] Appl. No.: 127,978

[22] Filed: Mar. 6, 1980

[30] Foreign Application Priority Data

Mar. 20, 1979 [JP] Japan ..... 54-31786

[51] Int. Cl.[3] ..... C23F 5/02; C23F 7/00

[52] U.S. Cl. ..... 148/6.21; 148/6.14 R; 204/1 T

[58] Field of Search ..... 148/6.21, 6.2, 6.14 R

[56] References Cited

U.S. PATENT DOCUMENTS 4,026,737 5/1977 Takahari et al. ..... 148/6.21

*Primary Examiner*—Ralph S. Kendall

*Attorney, Agent, or Firm*—Wenderoth, Lind & Ponack

[57] ABSTRACT

This invention relates to a method for coloring stainless steel by controlling the potential difference between the surface of the stainless steel being colored and a reference electrode in a coloring liquor, characterized by differentiating a potential-time curve showing the variation with time of the potential difference between the surface of the stainless steel and the reference electrode by time to prepare the differentiation curve thereof and removing the stainless steel from the coloring liquor when the potential difference has changed from the coloring starting point that is the inflexion point on this differentiation curve, at which the variation amount of the potential per unit time changes from a falling tendency to a rising tendency, by a predetermined amount associated with the desired color.

3 Claims, 4 Drawing Figures

METHOD FOR COLORING STAINLESS STEEL

BACKGROUND OF THE INVENTION

This invention relates to a method for coloring stainless steel, whereby stainless steel can be colored to a desired color tone with a satisfactory reproducibility even when it has a relatively uneven surface.

Recently, the techniques of coloring stainless steel have progressed rapidly, and in accordance with the increase in the production of colored stainless steel, it is now used in various fields. Among the conventional techniques, the method of coloring stainless steel by controlling potential difference between a reference electrode and the surface of stainless steel to be colored (which was developed by Inco Europe Limited in Britain) is particularly good in respect of reproducibility of color tone and hardwearing properties. This method is fully described in Japanese Patent Publication (Tokkō-shō) No. 52-25817 entitled "Method of Treating Chromium Alloys", which particularly fully discloses a method for controlling the reproducibility of color of stainless steel. The method disclosed therein comprises monitoring the potential difference between the surface of the stainless steel being colored and a reference electrode (such as a saturated calomel electrode or a platinum electrode and the like) in an aqueous solution of chromic and sulphuric acids; determining the inflexion potential at the inflexion point A at which the desired color begins to form on the metal surface and the finish potential B at which the formation of the desired color is complete on the basis of the potential-time curve showing the variation with time of the potential of the stainless steel, measured against the reference electrode, as given in FIG. 1; and removing the colored stainless steel from the coloring solution when the potential is varied from the inflexion point A to the potential B in accordance with the predetermined amount. That is, according to this method, the desired color tone can be obtained when the potential is varied from the inflexion point A to the potential B, and this variation of the potential difference appears constantly between the inflexion point A and the potential B, thus a constant color tone being produced by controlling the potential difference (B−A) from the inflexion point A.

However, it has been found that the appearance of the inflexion point A on the potential-time curve of FIG. 1 in accordance with this method varies depending on the state of the surface finish of stainless steel to be colored. Sometimes, this appearance is very indistinct, and in an extreme case the inflexion point A does not appear. When a stainless steel to be colored is subjected to bright annealing finish, very fine mirror polishing finish or 2B finish of skin pass finish by rolls having gloss after cold rolling, the surface of the stainless steel becomes relatively even, and the inflexion point A appears distinctly on the potential-time curve of FIG. 1. However, when the surface of a stainless steel to be colored is uneven, for example, when the stainless steel is subjected to a coarse abrading finish or HL finish by using a coarse abrasive material to leave a continuous abrading trace, the inflexion point A does not appear on the potential-time curve as shown in FIG. 1 but the curve as shown in FIG. 2 appears. That is, FIG. 2 shows an example of the potential-time curve showing the variation with time of the potential difference between the surface of an HL-finished SUS 304 stainless steel and a reference electrode, and in this case, the inflexion point A as shown in FIG. 1 does not appear.

As mentioned above, if the surface condition of a stainless steel is unacceptably bad, it is impossible to determine the inflexion point A from the potential-time curve, and it is therefore very difficult to control the color tone on the basis of the inflexion point A on the potential-time curve showing the variation with time of the potential difference between the surface of a stainless steel and a reference electrode. Thus, according to this method of the prior art, it is impossible to obtain a desired color tone with a satisfactory reproducibility when the surface condition of a stainless steel is unacceptably bad. Therefore, when a stainless steel to be colored has a relatively uneven surface such as a surface of HL finish, the stainless steel must be subjected to an electrolytic treatment, for example, by dipping the stainless steel in an aqueous solution of phosphoric acid before coloring in order to make the surface of the steel substantially even by forming a passive film on the surface, so that the inflexion point A as shown on the potential-time curve of FIG. 1, which is the key to controlling color tone, can appear distinctly when the pretreated stainless steel is dipped in a coloring liquor comprising a mixed aqueous solution of chromic and sulfuric acids. Alternatively, the coloring is controlled simply by the dipping time in the coloring liquor at the expense of reproducibility of the desired color.

We have fully studied the potential-time curve showing the variation with time of the potential difference between the surface of a stainless steel and a reference electrode in this coloring liquor, and have discovered that the inflexion point in question can be distinctly located even from the potential-time curve having no distinct inflexion point as shown in FIG. 2 by measuring a variation amount of potential per unit time, i.e. by differentiating the variation with time of the potential by time to prepare the differentiation curve thereof. Thus, we have found that a desired color tone can be obtained with a satisfactory reproducibility even in the case of a stainless steel having a relatively uneven and ununiform surface by controlling the coloring in accordance with this differentiation curve.

SUMMARY OF THE INVENTION

An object of this invention is to provide a method for coloring stainless steel by controlling the potential difference between the surface of stainless steel being colored and a reference electrode in a coloring liquor, characterized by differentiating a potential-time curve showing the variation with time of the potential difference between the surface of the stainless steel and the reference electrode by time to prepare the differentiation curve thereof and removing the stainless steel from the coloring liquor when the potential difference has changed from the coloring starting point that is the inflexion point on this differentiation curve, at which the variation amount of the potential per unit time changes from a falling tendency to a rising tendency, by a predetermined amount associated with the desired color.

DETAILED DESCRIPTION OF THE INVENTION

The method for coloring stainless steel of this invention is more fully described hereinafter.

The method for coloring stainless steel in accordance with this invention comprises dipping the stainless steel in a coloring liquor comprising a mixed aqueous solution of chromic acid and sulfuric acid to form an oxide film on the surface, the coloring to a desired color tone being controlled on the basis of the potential difference between the surface of the stainless steel and a reference electrode such as a platinum electrode dipped in the coloring liquor, wherein the coloring can be accurately controlled with a satisfactory reproducibility by checking a differentiation curve derived from a potential-time curve showing the variation with time of the potential difference between the surface of the stainless steel and the reference electrode by differentiating the variation amount of the potential difference per unit time (i.e. the variation amount with time of the potential difference) by time.

Figure 3:
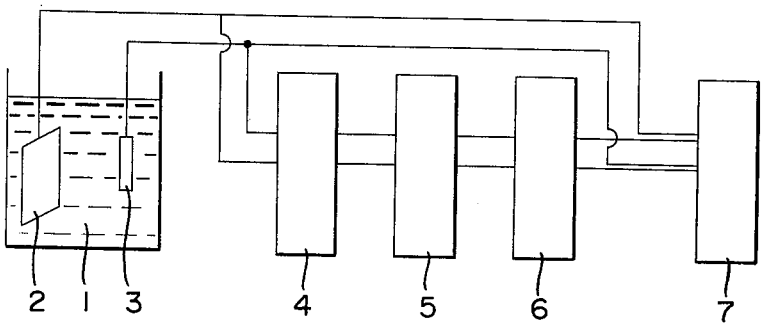
FIG. 3 is a schematic chart of an apparatus for measuring a potential-time curve and a differentiation curve of the potential-time curve by time.
Figure 4:
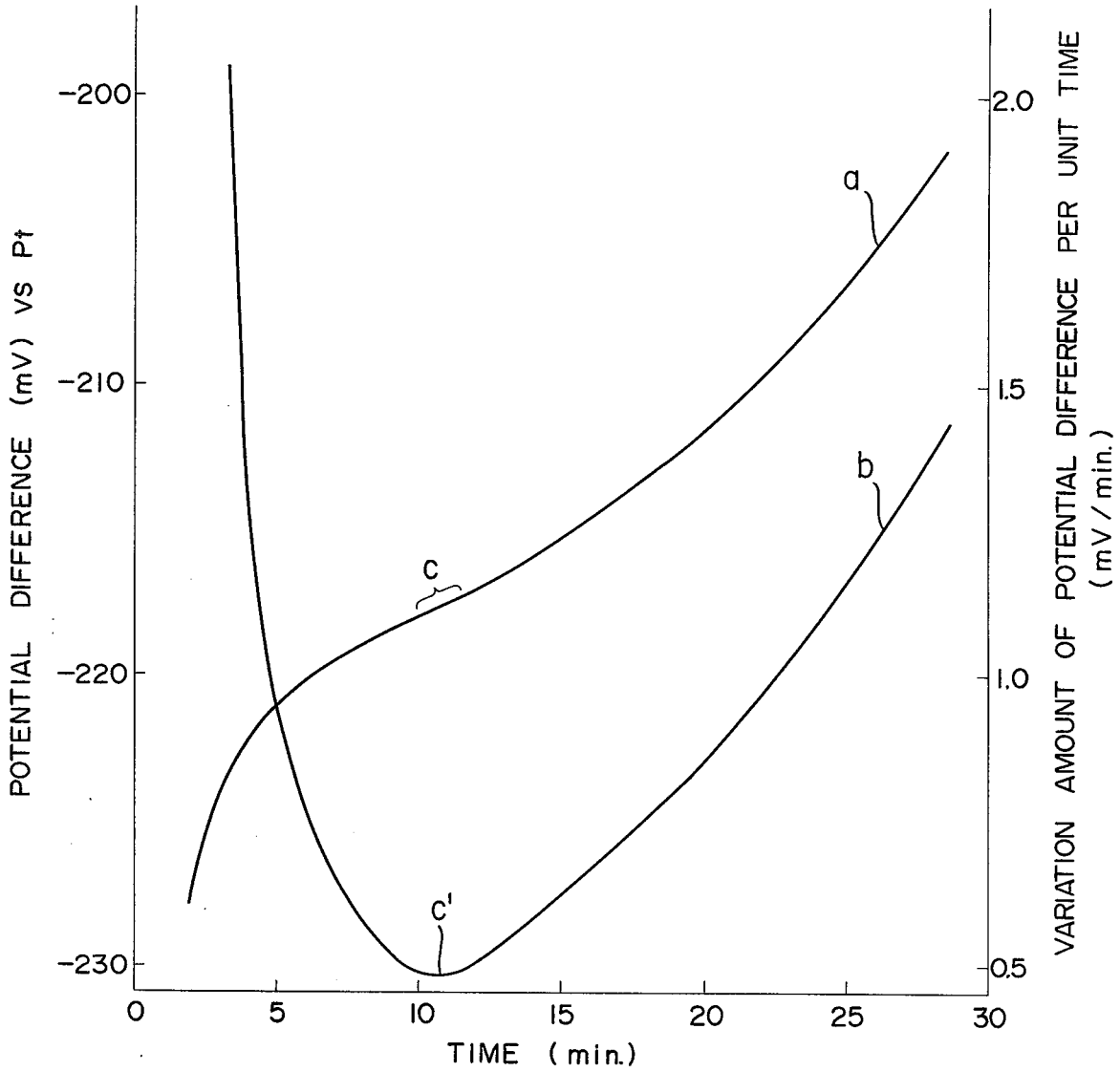
FIG. 4 shows a potential-time curve showing a variation with time of the potential difference between the surface of HL-finished SUS 304 stainless steel and a platinum reference electrode, and a differentiation curve of the potential-time curve by time.

As mentioned above, if a stainless steel to be colored has a relatively uneven surface, an inflexion point does not appear on a potential-time curve showing a variation with time of a potential difference between the surface of the stainless steel and a reference electrode, but the coloring starting point which corresponds to the inflexion point appears on a differentiation curve obtained by differentiating the variation with time of the potential difference by time. For example, with regard to HL-finished SUS 304 stainless steel, the potential difference between the surface of the stainless steel and a platinum reference electrode was measured, and the potential-time curve and the differentiation curve by time of the potential-time curve was prepared by means of the apparatus as shown in FIG. 3. FIG. 4 shows the above-prepared potential-time curve and the differentiation curve. In FIG. 3, the numeral 1 represents a coloring liquor; 2 represents a platinum reference electrode; 3 represents a stainless steel; 4 represents a digital mV meter; 5 represents a microcomputer; 6 represents a D/A converter; and 7 represents an analog recorder. In FIG. 4, the mark, (a) represents a potential-time curve, and the mark, (b) represents a differentiation curve by time of the potential-time curve (a). According to the potential-time curve (a) of FIG. 4, the potential difference rises with time, but an inflexion point does not appear on the curve even when reaching the coloring starting point C. Therefore, it is impossible to control the color tone of the stainless steel on the basis of this potential-time curve (a). However, the coloring starting point C' clearly appears as an inflexion point converting from a falling tendency to a rising tendency of the variation amount of the potential difference on the differentiation curve (b) derived by differentiating the potential-time curve (a) by time. Thus, even if a stainless steel has such an uneven surface that an inflexion point can not appear on the potential-time curve (a), the desired color tone can be controlled with a satisfactory reproducibility by locating the coloring starting point C' on the differentiation curve obtained by differentiating the variation with time of the potential difference.

Thus, the present invention is based on the discovery that the coloring of a stainless steel having a relatively uneven surface also can be accurately controlled with a satisfactory reproducibility by checking a differentiation curve obtained by differentiating the variation with time of potential difference by time, and consequently the method of this invention is characterized by differentiating a potential-time curve showing the variation with time of potential difference by time to prepare the differentiation curve thereof and removing the stainless steel from a coloring liquor when the potential difference has changed from the coloring starting point (that is, the inflexion point at which the variation amount of the potential per unit time converts from falling tendency to rising tendency on this differentiation curve) by a predetermined amount associated with the desired color. A potential-time curve and the differentiation curve of the potential-time curve are prepared by using the measuring apparatus system as illustrated in FIG. 3. For example, the differentiation curve is prepared by computing by a microcomputer a variation amount per unit time of potential difference between the surface of a stainless steel being colored and a reference electrode and plotting these values of the potential difference indicated on a recorder.

The method of the present invention is further illustrated by the following Examples.

EXAMPLE 1

Figure 1:
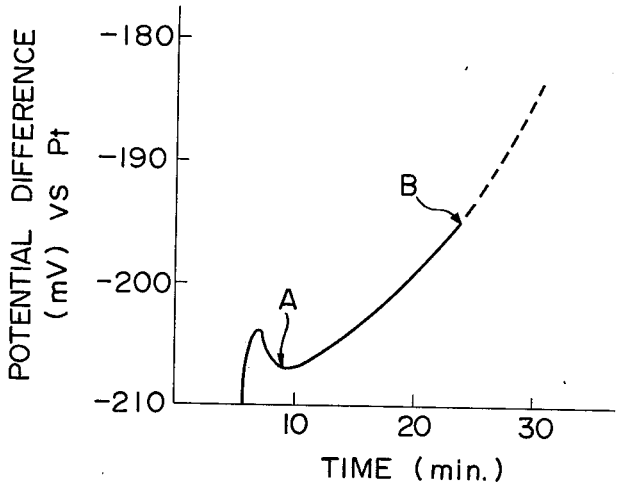
FIG. 1 shows a potential-time curve giving an example of a variation with time of the potential difference between the surface of a stainless steel having a relatively good surface finish and a reference electrode.
Figure 2:
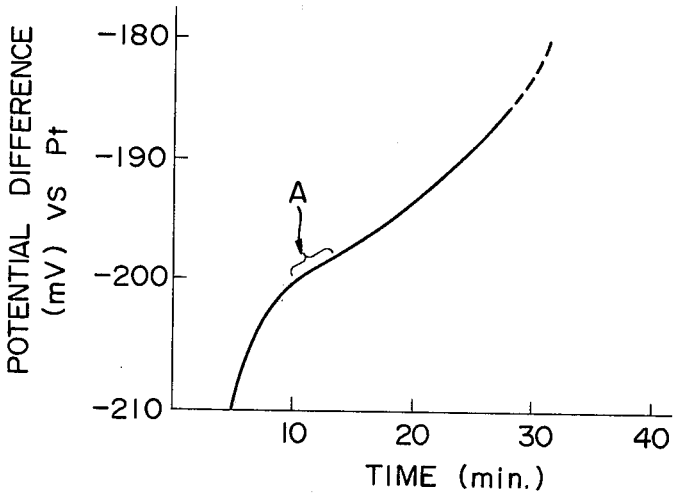
FIG. 2 shows a potential-time curve giving an example of a variation with time of the potential difference between the surface of a stainless steel having a relatively uneven surface and a reference electrode.

An HL-finished SUS 304 stainless steel abraded in such a manner as to leave a continuous abrasion trace on the surface by using an abrasive material having an appropriate particle size was used as a sample. This sample was immersed in a coloring liquor comprising a mixed aqueous solution of chromic acid 250 g/liter and sulfuric acid 500 g/liter to color the surface, and the potential difference between the surface of the sample and a platinum reference electrode in the coloring liquor was measured by the measuring system as illustrated in FIG. 3 to prepare a potential-time curve showing a variation with time of the potential difference and a differentiation curve obtained by differentiating said variation with time of the potential difference by time. As the result of this, the potential-time curve (a) and the differentiation curve (b) as shown in FIG. 4 were obtained. In the potential-time curve (a), the variation of the potential difference slowly rose with time, and an inflexion point as shown in FIG. 1 did not appear. Therefore, it was impossible to control the coloring on the basis of this curve. On the other hand, in the differentiation curve (b) obtained by differentiating the potential-time curve (a) by time, the coloring starting point C' was clearly indicated by an inflexion point at which the variation amount of the potential difference per unit time converts from a falling tendency to a rising tendency, the coloring starting point thus being distinctly determined.

EXAMPLE 2

An SUS 304 stainless steel abraded with #150 abrasive material was used as a sample. This sample was immersed in the same coloring liquor as used in Example 1 to color the surface in the same manner as in Example 1. The potential difference between the surface of the sample and a platinum reference electrode was measured and a potential-time curve showing a variation with time of the potential difference and a differentiation curve obtained by differentiating said variation with time of the potential difference by time were prepared also in the same manner as in Example 1. The potential-time curve and the differentiation curve thus obtained had the same tendencies as those shown in FIG. 4, and the coloring starting point was clearly determined from the differentiation curve.

The change in potential from the coloring starting point to the finish potential at which the formation of the desired color is complete, that is, the preferable potential range which gives the desired color was determined. When the finish potential was reached, the stainless steel was removed from the coloring liquor. The reproducibility of the color tone thus controlled on the basis of the differentiation curve was checked in accordance with Method of Measurement for Colour of Materials Based on the CIE 1931 Standard Colorimetric System.

In the same manner as above, the reproducibility of the color tone of the stainless steel colored by controlling in accordance with the conventional method was checked.

The results are shown in the following Table. The indication of the color was made according to "the color difference indication method" as defined in JIS Z8730.

TABLE

| | Target Color | Reproducibility of Color Tone: Color Indicated by JIS Z8730 L | a | b | Color Difference ΔE | Color Evaluated by the Naked Eye |
|---|---|---|---|---|---|---|
| The Method of This Invention | Green | 31.92 | −2.64 | −1.31 | — | Green |
| | " | 31.80 | −2.60 | −1.33 | 0.13 | " |
| | " | 31.90 | −2.58 | −1.27 | 0.07 | " |
| | " | 31.60 | −2.57 | −1.29 | 0.33 | " |
| | Gold | 38.57 | 0.94 | 8.58 | — | Gold |
| | " | 38.60 | 0.90 | 8.50 | 0.09 | " |
| | " | 38.71 | 0.93 | 8.71 | 0.19 | " |
| | " | 38.40 | 0.88 | 8.62 | 0.18 | " |
| The Conventional Method | Green | 31.92 | −2.64 | 1.31 | — | Green |
| | " | 31.73 | −2.01 | −0.01 | 1.47 | Blue |
| | " | 31.60 | −2.23 | −1.51 | 2.87 | Blue-Green |
| | " | 31.85 | −3.05 | −2.40 | 3.73 | Yellow-Green |
| | Gold | 38.57 | 0.94 | 8.58 | — | Gold |
| | " | 38.01 | 1.20 | 9.03 | 0.76 | " |
| | " | 37.98 | 0.21 | 7.34 | 1.56 | Yellow-Green |
| | " | 38.98 | −0.35 | 7.25 | 1.89 | " |

Note:
Color was measured by 307 Type Color Analyzer manufactured by Hitachi Seisaku-sho K.K.

The samples were respectively colored four times to the target color, "green" or "gold". As can be seen from the above Table, in the case of the coloring controlled by the method of this invention, the color difference ΔE was very small and the evaluation by the naked eye was also excellent, thus proving that the reproducibility of the color tone was quite satisfactory. On the other hand, in the case of the coloring controlled by the conventional method, the color difference ΔE was large, and the color evaluated by the naked eye included variously blue, blue-green, or yellow-green when the target color was "green", and included yellow-green when the target color was "gold". Thus, the reproducibility of the color tone was very bad.

As fully mentioned above, the method for coloring stainless steel with a satisfactory reproducibility in accordance with this invention comprises immersing the stainless steel in a coloring liquor comprising a mixed aqueous solution of chromic acid and sulfuric acid to form an oxide film on the surface, characterized in that the coloring is controlled by firstly determining a coloring starting point from a differentiation curve obtained by differentiating by time a potential-time curve showing a variation with time of the potential difference between the surface of the stainless steel and a reference electrode, and secondly keeping watch on the potential change from the coloring starting point to the value associated with the desired color. According to the present invention, even if an inflexion point does not appear on a potential-time curve as in the case of a stainless steel having a relatively uneven surface, such as an HL-finished stainless steel, the desired color can be obtained and the coloring can be controlled with a satisfactory reproducibility. Thus, the present invention has a large advantage and a high commercial value.

What we claim is:

1. A method for coloring stainless steel by controlling the potential difference between the surface of the stainless steel being colored and a reference electrode in a coloring liquor, characterized by differentiating a potential-time curve showing the variation with time of the potential difference between the surface of the stainless steel and the reference electrode by time to prepare the differentiation curve thereof and removing the stainless steel from the coloring liquor when the potential difference has changed from the coloring starting point that is the inflexion point on this differentiation curve, at which the variation amount of the potential per unit time changes from a falling tendency to a rising tendency, by a predetermined amount associated with the desired color.

2. A method according to claim 1, wherein said coloring liquor comprises a mixed aqueous solution of chromic acid and sulfuric acid.

3. A method according to claim 1 or 2, wherein said reference electrode is a platinum electrode.

* * * * *